US008813659B2

(12) United States Patent
Kuo et al.

(10) Patent No.: US 8,813,659 B2
(45) Date of Patent: Aug. 26, 2014

(54) PALLET WITH ROTATABLE LEGS

(71) Applicant: Shenzhen China Star Optoelectronics Technology Co., Ltd., Guangdong (CN)

(72) Inventors: Yicheng Kuo, Shenzhen (CN); Shihhsiang Chen, Shenzhen (CN); Jiahe Cheng, Shenzhen (CN); Chengwen Que, Shenzhen (CN); Qinjun Shi, Shenzhen (CN); Jiaxin Li, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 53 days.

(21) Appl. No.: 13/806,810

(22) PCT Filed: Nov. 28, 2012

(86) PCT No.: PCT/CN2012/085380

§ 371 (c)(1),
(2), (4) Date: Dec. 24, 2012

(87) PCT Pub. No.: WO2014/079080

PCT Pub. Date: May 30, 2014

(65) Prior Publication Data

US 2014/0174328 A1 Jun. 26, 2014

(30) Foreign Application Priority Data

Nov. 21, 2012 (CN) ..... 2012 1 0476710

(51) Int. Cl.

| | |
|---|---|
| ***B65D 19/38*** | (2006.01) |
| ***B65D 19/40*** | (2006.01) |
| ***B65D 19/00*** | (2006.01) |

(52) U.S. Cl.

CPC .. *B65D 19/0028* (2013.01); *B65D 2519/00865* (2013.01); *B65D 19/40* (2013.01); *B65D 19/38* (2013.01); *B65D 19/0004* (2013.01)

USPC ..... 108/54.1; 108/53.1

(58) Field of Classification Search

CPC ..... B65D 2519/00671; B65D 2519/00676; B65D 2519/00686; B65D 2519/00691; B65D 2519/00696; B65D 2519/00865; B65D 2519/0087

USPC ..... 108/51.11, 54.1, 56.1, 56.3, 57.12, 108/53.1; 248/346.01, 346.02; 206/386, 206/599, 600, 597

See application file for complete search history.

(56) References Cited

U.S. PATENT DOCUMENTS 1,700,843 A * 2/1929 Hayward ..... 34/238
2,774,609 A * 12/1956 Winger ..... 280/79.11

(Continued)

FOREIGN PATENT DOCUMENTS

CN 2279323 Y 4/1998
CN 2661599 Y 12/2004

(Continued)

*Primary Examiner* — Jose V Chen
(74) *Attorney, Agent, or Firm* — Andrew C. Cheng

(57) ABSTRACT

A pallet includes a pallet body, a plurality of recesses formed in a bottom of the pallet body, two retention tabs mounted to the bottom of the pallet body and respectively extending downward from two opposite sides of each of the recesses, and a plurality of legs mounted to the retention tabs and respectively receivable in the recesses. The pallet includes the rotatable legs, so that in using the pallet, the legs are rotated out and the coupling pins are applied to fix the legs for supporting and when the pallet is not in use, the coupling pins are removed to allow the legs to rotate in order to set the legs in recesses, whereby the pallet occupies a reduced amount of space for storage and transportation and thus the capacity of storage and transportation can be improved to thus lower down transportation cost.

9 Claims, 4 Drawing Sheets

(56) References Cited

U.S. PATENT DOCUMENTS

| | | | | |
|---|---|---|---|---|
| 3,523,507 | A * | 8/1970 | Dubin | 108/57.12 |
| 3,558,152 | A * | 1/1971 | Miles et al. | 280/47.16 |
| 5,617,689 | A * | 4/1997 | Beane | 52/489.1 |
| 5,868,371 | A * | 2/1999 | Nuzzo | 248/346.01 |
| 6,637,351 | B1 * | 10/2003 | Brennan et al. | 108/54.1 |
| 7,431,531 | B2 * | 10/2008 | Carnevali | 403/328 |
| 8,505,469 | B2 * | 8/2013 | Liu et al. | 108/56.3 |

FOREIGN PATENT DOCUMENTS

| | | | |
|---|---|---|---|
| CN | 101670898 | A | 3/2010 |
| CN | 201634005 | U | 11/2010 |
| EP | 2112081 | A1 | 10/2009 |
| FR | 2765193 | A1 | 12/1998 |
| FR | 2966440 | A1 | 4/2012 |

* cited by examiner

PALLET WITH ROTATABLE LEGS

BACKGROUND OF THE INVENTION

1. Field of the Invention

The present invention relates to the field of packaging material, and in particular to a pallet used circulating cargos.

2. The Related Arts

Pallets have very wide applications and are generally used to carry cargos for easy warehousing and transportation among different sites. The pallets can be re-used after the cargos are removed. According to the material used, there are wood pallets, plastic pallets, and metal pallets. In the field of manufacture of liquid crystal display devices, the manufacture of liquid crystal display devices includes a process of assembling, which assembles various components, including a liquid crystal panel, a main control circuit, and an enclosure, together. These components are each manufactured in advance and packaged for being later assembled to form a complete liquid crystal display device. The liquid crystal panels, after being manufactured, are packaged in a package box and then shipped to a corresponding assembling station with the box. The warehousing of the finished product and semi-finished products of liquid crystal display devices is often done with pallets. However, the conventional pallet is often made integrally as a unity and causes a waste of space in transportation and stacking. As shown in FIGS. 1 and 2, which are a schematic view showing a conventional integral pallet and a schematic view illustrating stacking of the pallet, a pallet 100 has legs 102 that are formed integrally with a pallet body 104. Spaces are formed between legs 102, so that a number of pallets 100, when stacked, occupy a large amount of space, which lowers the capacity of transportation and that of warehousing, thereby increasing the costs for transportation.

SUMMARY OF THE INVENTION

An object of the present invention is to provide a pallet, which has an adjustable size to be fit for packaging of various sizes of liquid crystal panel and occupies a small amount of space for warehousing and transportation.

To achieve the object, the present invention provides a pallet, which comprises a pallet body, a plurality of recesses formed in a bottom of the pallet body, two retention tabs mounted to the bottom of the pallet body and respectively extending downward from two opposite sides of each of the recesses, and a plurality of legs mounted to the retention tabs and respectively receivable in the recesses.

The pallet body is in the form of a flat board.

The legs each have two opposite side faces each of which forms a projection. The retention tabs form first through holes corresponding to the projections. The projections are received and retained in the first through holes in such a way that the legs are rotatably coupled to the retention tabs.

The legs each form a second through hole extending through the two opposite side faces. The retention tabs each form a third through hole corresponding to the second through hole. A coupling pin is receivable through the third through holes and the second through hole to retain the leg to the retention tabs.

The legs are of a cubic form.

The recesses have a depth that is greater than or equal to a diagonal length of the side faces of the legs.

The pallet body comprises six recesses formed in the bottom thereof. The six recesses are arranged along two opposite sides of the pallet body.

The legs are of a number of six and are respectively mounted in the six recesses. Three of the legs that are located along the same side are fixable by a common coupling pin.

The pallet body and the retention tabs are integrally formed together.

The legs and the projections thereof are integrally formed together.

The present invention also provides a pallet, which comprises a pallet body, a plurality of recesses formed in a bottom of the pallet body, two retention tabs mounted to the bottom of the pallet body and respectively extending downward from two opposite sides of each of the recesses, and a plurality of legs mounted to the retention tabs and respectively receivable in the recesses;

wherein the pallet body is in the form of a flat board;

wherein the legs each have two opposite side faces each of which forms a projection, the retention tabs forming first through holes corresponding to the projections, the projections being received and retained in the first through holes in such a way that the legs are rotatably coupled to the retention tabs;

wherein the legs each form a second through hole extending through the two opposite side faces, the retention tabs each forming a third through hole corresponding to the second through hole, a coupling pin being receivable through the third through holes and the second through hole to retain the leg to the retention tabs;

wherein the legs are of a cubic form;

wherein the recesses have a depth that is greater than or equal to a diagonal length of the side faces of the legs;

wherein the pallet body comprises six recesses formed in the bottom thereof, the six recesses being arranged along two opposite sides of the pallet body;

wherein the legs are of a number of six and are respectively mounted in the six recesses, three of the legs that are located along the same side being fixable by a common coupling pin;

wherein the pallet body and the retention tabs are integrally formed together; and wherein the legs and the projections thereof are integrally formed together.

The efficacy of the present invention is that the present invention provides a pallet, which comprises rotatable legs, so that in using the pallet, the legs are rotated out and coupling pins are applied to fix the legs for supporting and when the pallet is not in use, the coupling pins are removed to allow the legs to rotate in order to set the legs in recesses, whereby the pallet in entirety occupies a reduced amount of space for storage and transportation and thus the capacity of storage and transportation can be improved to thus lower down transportation cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
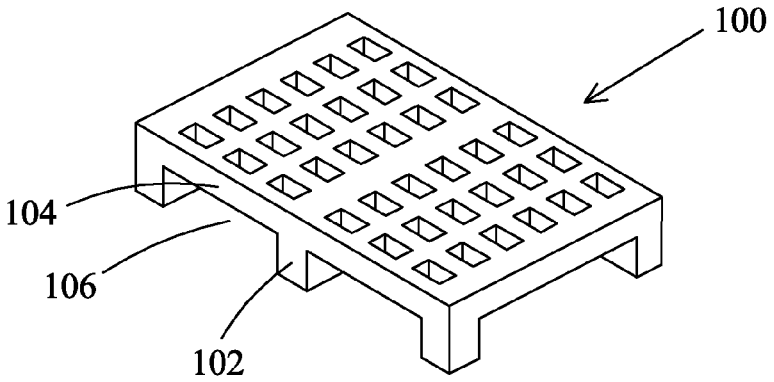
FIG. 1 is a schematic view showing the structure of a conventional integrally-formed pallet.
Figure 2:
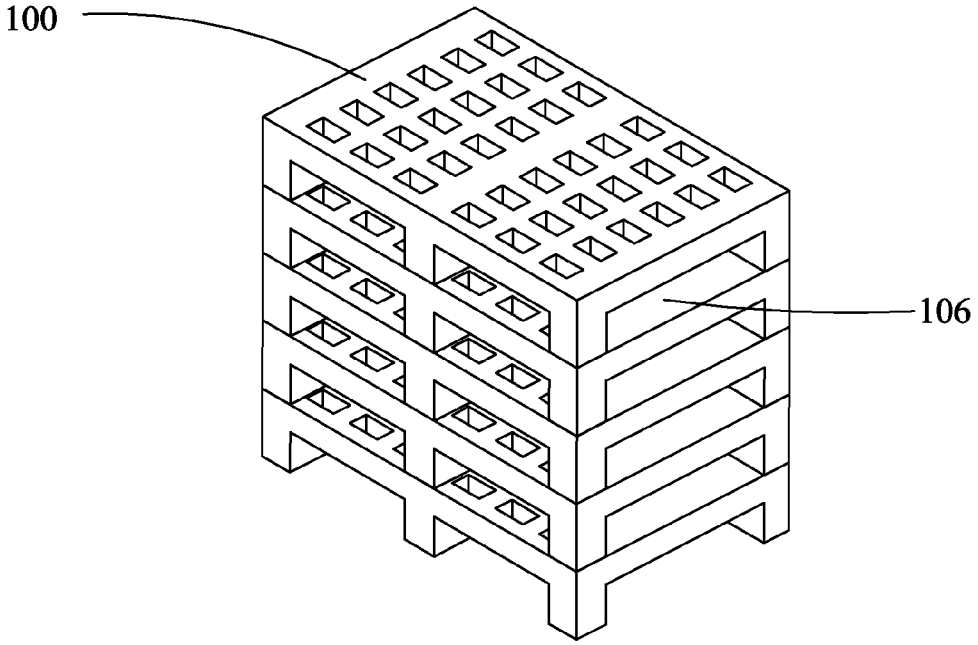
FIG. 2 is a schematic view showing stacking of the pallet shown in FIG. 1.
Figure 3:
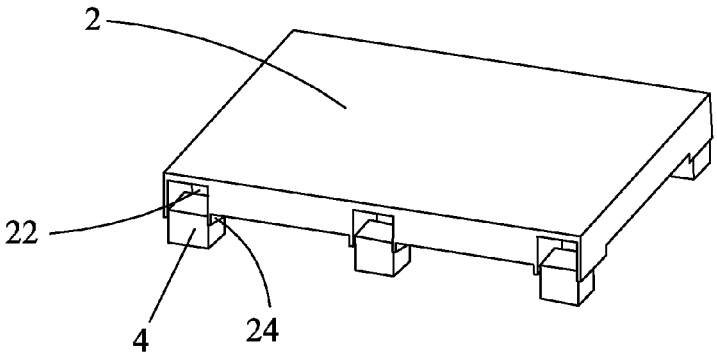
FIG. 3 is a front view showing a pallet according to the present invention in a condition ready to receive cargos to be deposited thereon.
Figure 4:
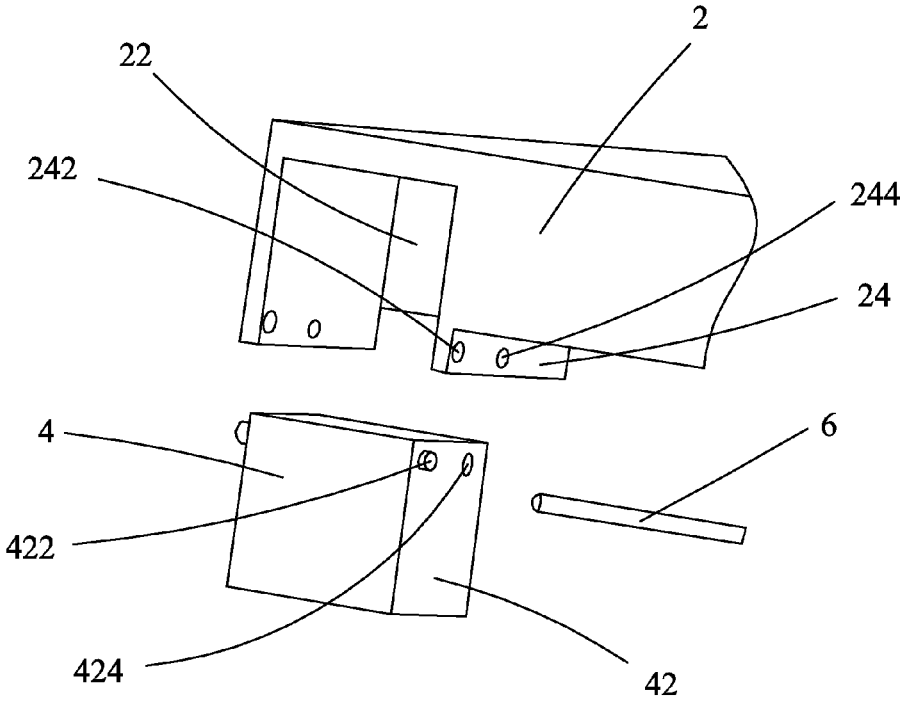
FIG. 4 is an exploded view showing the pallet according to the present invention.
Figure 5:
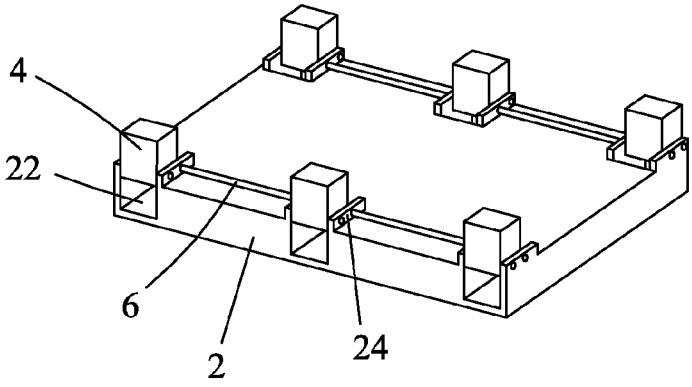
FIG. 5 is a schematic view showing the bottom structure of the pallet of FIG. 3.
Figure 6:
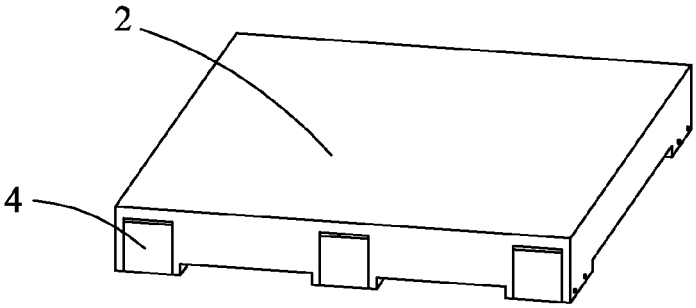
FIG. 6 is a schematic view showing the front structure in a condition where legs of the pallet according to the present invention are received in recesses.
Figure 7:
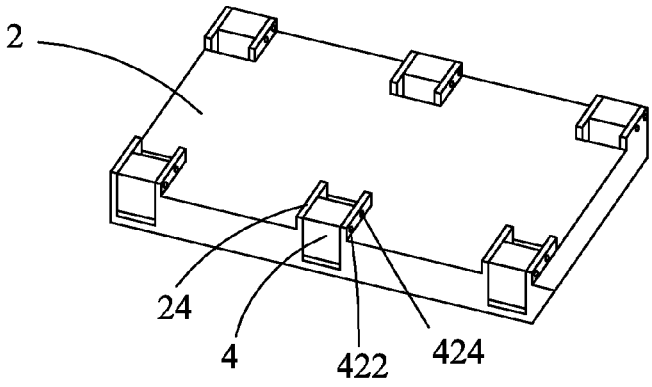
FIG. 7 is a schematic view showing the bottom structure of the pallet of FIG. 6.
Figure 8:
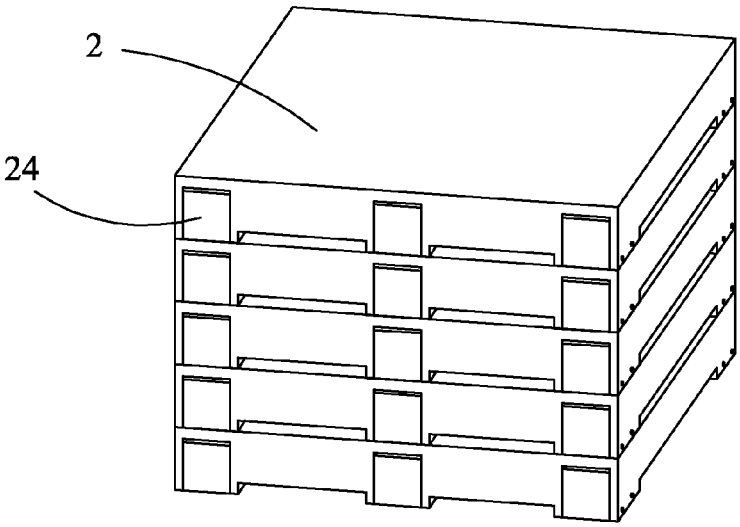
FIG. 8 is a schematic view illustrating stacking of the pallet of FIG. 6.

Referring to FIGS. 3-8, the present invention provides a pallet, which comprises a pallet body 2, a plurality of recesses 22 formed in a bottom of the pallet body 2, two retention tabs 24 mounted to the bottom of the pallet body 2 and respectively extending downward from two opposite sides of each of the recesses 22, and a plurality of legs 4 mounted to the retention tabs 24 and respectively receivable in the recesses 22. To use, the legs 4 are rotated out of the recesses 22 to support the pallet body 2. When not in use, the legs 4 are rotated 270° to get into the recesses 22 in order to reduce space occupation rate.

In the instant embodiment, the pallet body 2 is in the form of a flat board. The legs 4 are of a cubic form and each has two opposite side faces 42 each of which forms a projection 422. The retention tabs 24 form first through holes 242 corresponding to the projections 422. The projections 422 are received and retained in the first through holes 242 in such a way that the legs 4 are rotatably coupled to the retention tabs 24. To use, the legs 4 are rotated out of the recesses 22 to support the pallet body 2 and to store, the legs 4 are rotated 270° to get into the recesses 22 in order to reduce space occupation rate.

The legs 4 each form a second through hole 424 extending through the two opposite side faces 42. The retention tabs 24 each form a third through hole 244 corresponding to the second through hole 424. A coupling pin 6 is receivable through the third through holes 244 and the second through hole 424 to retain the leg 4 to the retention tabs 24. To use the pallet, the legs 4 are rotated out of the recesses 22 and the coupling pins 6 are respectively put through the third through holes 244 and the corresponding second through hole 424 to fix the legs 4 in order to improve the strength of coupling therebetween.

The recesses 22 have a depth that is greater than or equal to a diagonal length of the side faces 42 of the legs 4. Preferably, the depth of the recesses 22 is greater than the diagonal length of the side faces 42 of the legs 4 to allow easy rotation of the legs 4 into the recesses 22.

In the instant embodiment, the pallet body 2 comprises six recesses 22 formed in the bottom thereof. The six recesses 22 are arranged along two opposite sides of the pallet body 2. The legs 4 are of a number of six and are respectively mounted in the six recesses 22. Three of the legs 4 that are located along the same side can be fixed by a common coupling pin 6 in order to improve operation efficiency and reduce manufacturing cost.

The pallet body 2 and the retention tabs 24 are integrally formed together with a material, such as plastics or wood. The legs 4 and the projections 422 thereof are integrally formed together with a material, such as plastics or wood. The coupling pins 6 are made of a material such as plastics and wood, which shows a predetermined strength and stiffness in order to improve the quality of pallet.

In summary, the present invention provides a pallet, which comprises rotatable legs, so that in using the pallet, the legs are rotated out and coupling pins are applied to fix the legs for supporting and when the pallet is not in use, the coupling pins are removed to allow the legs to rotate in order to set the legs in recesses, whereby the pallet in entirety occupies a reduced amount of space for storage and transportation and thus the capacity of storage and transportation can be improved to thus lower down transportation cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A pallet, comprising a pallet body, a plurality of recesses formed in a bottom of the pallet body, two retention tabs mounted to the bottom of the pallet body and respectively extending downward from two opposite sides of each of the recesses, and a plurality of legs mounted to the retention tabs and respectively receivable in the recesses;

wherein the legs each have two opposite side faces each of which forms a cylindrical projection, the retention tabs forming first through holes that are circular and correspond to the projections, the cylindrical projections being rotatably received in the first through holes to allow the legs to be rotatable with respect to the retention tabs between a first position where the legs are received in the recesses and a second position where the legs extend outside the recesses; and wherein the legs each form a second through hole extending through the two opposite side faces, the retention tabs each forming a third through hole corresponding to the second through hole, a coupling pin being selectively insertable, in an axial direction thereof, into the third through holes and the second through hole to retain the leg in the second position, the coupling pin being immobile in a direction perpendicular to the axial direction thereof when inserted into the third through holes and the second through hole.

2. The pallet as claimed in claim 1, wherein the pallet body is in the form of a flat board.

3. The pallet as claimed in claim 1, wherein the legs are of a cubic form.

4. The pallet as claimed in claim 3, wherein the recesses have a depth that is greater than or equal to a diagonal length of the side faces of the legs.

5. The pallet as claimed in claim 1, wherein the pallet body comprises six recesses formed in the bottom thereof, the six recesses being arranged along two opposite sides of the pallet body.

6. The pallet as claimed in claim 5, wherein the legs are of a number of six and are respectively mounted in the six recesses, three of the legs that are located along the same side being fixable by a common coupling pin.

7. The pallet as claimed in claim 1, wherein the pallet body and the retention tabs are integrally formed together.

8. The pallet as claimed in claim 1, wherein the legs and the projections thereof are integrally formed together.

9. A pallet, comprising a pallet body, a plurality of recesses formed in a bottom of the pallet body, two retention tabs mounted to the bottom of the pallet body and respectively extending downward from two opposite sides of each of the recesses, and a plurality of legs mounted to the retention tabs and respectively receivable in the recesses;

wherein the pallet body is in the form of a flat board;

wherein the legs each have two opposite side faces each of which forms a cylindrical projection, the retention tabs forming first through holes that are circular and correspond to the projections, the cylindrical projections being received in the first through holes to allow the legs to be rotatable with respect to the retention tabs between a first position where the legs are received in the recesses and a second position where the legs extend outside the recesses;

wherein the legs each form a second through hole extending through the two opposite side faces, the retention tabs each forming a third through hole corresponding to the second through hole, a coupling pin being selectively insertable, in an axial direction thereof, into the third through holes and the second through hole to retain the leg in the second position, the coupling pin being immobile in a direction perpendicular to the axial direction thereof when inserted into the third through holes and the second through hole;

wherein the legs are of a cubic form;

wherein the recesses have a depth that is greater than or equal to a diagonal length of the side faces of the legs;

wherein the pallet body comprises six recesses formed in the bottom thereof, the six recesses being arranged along two opposite sides of the pallet body;

wherein the legs are of a number of six and are respectively mounted in the six recesses, three of the legs that are located along the same side being fixable by a common coupling pin;

wherein the pallet body and the retention tabs are integrally formed together; and wherein the legs and the projections thereof are integrally formed together.

* * * * *